US007175251B2

(12) United States Patent
Gaston et al.

(10) Patent No.: US 7,175,251 B2
(45) Date of Patent: Feb. 13, 2007

(54) REMOVING INK WASTE

(75) Inventors: Gonzalo Gaston, Barcelona (ES); Antonio Monclus, Barcelona (ES); Lluis Valles, Barcelona (ES); Macia Sole, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 210 days.

(21) Appl. No.: 10/762,303

(22) Filed: Jan. 23, 2004

(65) Prior Publication Data

US 2005/0162458 A1 Jul. 28, 2005

(51) Int. Cl.
*B41J 2/165* (2006.01)

(52) U.S. Cl. ..... 347/22; 347/26; 347/33; 347/36

(58) Field of Classification Search ..... 347/22
See application file for complete search history.

(56) References Cited

U.S. PATENT DOCUMENTS 6,340,220 B1 * 1/2002 Gaylor et al. ..... 347/35
6,508,552 B1 * 1/2003 Steinfield et al. ..... 347/102
6,663,215 B2 * 12/2003 Klausbruckner et al. ..... 347/22
6,764,160 B1 * 7/2004 Phillips et al. ..... 347/32

FOREIGN PATENT DOCUMENTS

JP 2002211007 A * 7/2002

* cited by examiner

*Primary Examiner*—Stephen Meier
*Assistant Examiner*—Brian J. Goldberg
(74) *Attorney, Agent, or Firm*—Foley & Lardner LLP

(57) ABSTRACT

A hardcopy device such as an ink-jet printer comprises a printhead, a spittoon for receiving waste ink from the printheads, and a heater for quickly drying the ink waste products in the spittoon. A drum platen having a print media supporting area also has an elongate spittoon region extending across its circumferential surface, the contents of the spittoon region being arranged to be removed intermittently by an elongate scraper which, in one position of the drum, can be moved radially towards the drum to contact the spittoon region.

12 Claims, 5 Drawing Sheets

REMOVING INK WASTE

The present invention relates to the removal of ink waste from hardcopy devices such as inkjet printers.

BACKGROUND OF THE INVENTION

When a hardcopy device such as an inkjet printer is not in use, pigment in the ink in its printheads tend to be deposited around each printhead nozzle leaving relatively thin ink, i.e. with a higher proportion of solvent, in the nozzle itself. To avoid deterioration in print quality after a period of non-use, a servicing operation needs to be undertaken to ensure correct operation of the nozzle immediately on commencement of a subsequent printing operation. This typically involves wiping of the nozzle with an elastomeric wiper blade and the spitting of some drops of ink from the nozzle so that it contains ink of the required formulation. The wasted drops of ink are captured within a device known as a spittoon.

The spittoon needs to be of a size corresponding at least to the maximum amount of ink it is expected to contain. Disposing of ink waste materials from a printer usually poses problems regarding satisfactory containment, the danger of liquid spills and environmental considerations. Spittoons contain liquid or semi-liquid materials, and need to be handled with care by end users. Existing spittoons can be categorised as:

a) Permanent spittoons, in cases in which the total amount of ink waste is relatively limited over the lifetime of a printer. However, permanent spittoons are unsuitable where there is little space for storage and/or the predicted amount of ink waste is relatively high.

b) Disposable cleaning cartridges, in which a cartridge or cassette comprises a relatively small spittoon, a wiper and a printhead cap. The cartridge is designed to handle a given amount of waste ink, and is arranged to be replaced at intervals, typically at the same time as a corresponding printhead or other component. The size of the spittoon is selected in accordance with the expected amount of waste ink between being replaced.

c) Disposable service station, which is similar to category b) except that all the service station parts are replaced simultaneously. In practice, the service station is replaced independently of the printheads.

The question of the removal of waste ink product becomes an increasing problem as the number of printhead nozzles increases, as a printer's duty cycles become heavier and as the proportion of pigment in modern inks increases. The problem directly affects such issues as spittoon size and replacement frequency but also the intervention rate, handling, liquids disposal and machine size.

To reduce the volume of the accumulated waste ink product, it is possible to collect it in solid form. U.S. Pat. No. 5,617,124 discloses a printer with a service station located at one end of the path of travel of a scanning printhead carriage, the service station incorporating a spittoon in the form of a rotating circular trough. Ink previously purged from the printheads is removed from the trough by a scraper and accumulated ink solids fall to the bottom of a spittoon chamber.

U.S. Pat. No. 6,340,220 discloses a printer service station arranged at one end of the path of a scanning printer. The service station comprises a spittoon wheel arranged with its axis parallel to the scanning axis of the printer and having a circumferential surface arranged to receive ink ejected from a printhead. Liquid components of ink waste are removed from the surface of the wheel, with the assistance of a scraper, into a temporary container from where solid ink residue is transferred to a further storage location.

Scanning type printers, as disclosed in the above-mentioned U.S. patents, are well known, in which printheads are mounted on a carriage which undertakes reciprocating movements between two end positions. A print medium moves underneath the printheads in a direction perpendicular to the direction of the carriage scanning movements. To undertake servicing operations with respect to the printheads, such as capping, wiping, priming and spitting, they are moved beyond one of the end positions to be located adjacent to a service station. This is time-consuming and a precise positioning system is required to ensure that the printheads are accurately returned to the correct printing position after a servicing operation has been undertaken.

This problem is avoided in a page-wide array type of printer, in which one or more fixed printheads extend over the entire width of the printing path. However, undertaking a servicing operation on the printheads again required a precise positioning system to allow the various printer components to move between their printing and servicing configurations.

U.S. Pat. No. 5,081,472 discloses a service station for a page-wide array printer. The service station comprises a rotatable drum which can be pivoted from a servicing position into a position where it is clear of the printhead to permit a printing operation.

Co-pending U.S. patent application Ser. No. 10/426,574 discloses a hardcopy device comprising a drum platen having a circumferential surface for supporting print media as they move relative to one or more print bars, the circumferential surface also comprising an axially-extending recessed area constituting a spittoon arrangement for the print bars. The contents of this co-pending application are hereby incorporated by reference.

SUMMARY OF THE INVENTION

Certain aspects of the present invention seek to provide a spittoon arrangement in which the ink waste product is dried relatively quickly. This permits an enhanced reduction in the volume of the waste product. This in turn permits a higher rate of spitting from the printheads. It also reduces the risk of contamination of the hardcopy device and/or a print media by liquid ink being thrown off by movement of a spittoon.

According to a first aspect of the present invention, there is provided a hardcopy device comprising a printhead, a spittoon arranged to receive ink from said printhead, and a heater arranged to heat ink received in said spittoon.

According to a second aspect of the present invention, there is provided a hardcopy device comprising means defining a print media path, printing means arranged to fire ink at a print media as it moves along said path, spittoon means for receiving waste ink from said printing means, means for producing relative movement between said printing means and said spittoon means, and means for heating ink received in said spittoon means.

According to a third aspect of the present invention, there is provided a service station module for a hardcopy device, said component comprising a spittoon and a heater for said spittoon.

According to a fourth aspect of the present invention, there is provided a method of operating a hardcopy device having a printhead and a spittoon for receiving ink from said printhead, comprising the steps of: producing relative movement of said printhead and said spittoon to bring them into a mutually adjacent position; firing ink from said printhead into said spittoon; and heating said ink.

According to a fifth aspect of the present invention, there is provided a computer program comprising program code for performing the steps of a method according to the fourth aspect when said program is run on a processing device associated with a suitable hardcopy device.

Certain aspects of the invention seek to provide a spittoon arrangement from which dried ink waste product is removed relatively quickly and efficiently.

According to a sixth aspect of the present invention there is provided a hardcopy device comprising a rotatable drum, an elongated spittoon region extending across substantially the entire width of the circumferential surface of said drum, and a removal device for removing the contents of said spittoon region, said removal device being movable radially relative to said drum.

According to a seventh aspect of the present invention, there is provided a method of operating a hardcopy device having a printhead and a drum platen mounted to rotate relative to said printhead, said drum platen having an elongate spittoon region for receiving ink from said printhead, said spittoon region extending across substantially the entire width of the circumferential surface of said drum platen, the method comprising the steps of firing ink from said printhead into said spittoon, rotating said drum platen to move said spittoon region adjacent to a removal device for removing the contents of said spittoon region, and moving said removal device radially relative to said drum platen.

As used herein the term "ink" includes coloured inks and also other liquids which are printed on print media, such as "fixers" and liquids including biological specimens.

The expression "hardcopy device" covers not only printers (e.g. of the ink-jet type) but also photocopiers, scanners and facsimile machines.

A service station is a component part of a hardcopy device which undertakes one or more operations on the printheads or print bars thereof. Each operation is undertaken by a respective part of the servicing station known as a servicing module.

BRIEF DESCRIPTION OF THE DRAWINGS

A preferred embodiment of the present invention will now be described, by way of example only, with reference to the accompanying drawings, of which.

DESCRIPTION OF THE PREFERRED EMBODIMENTS

Figure 1:
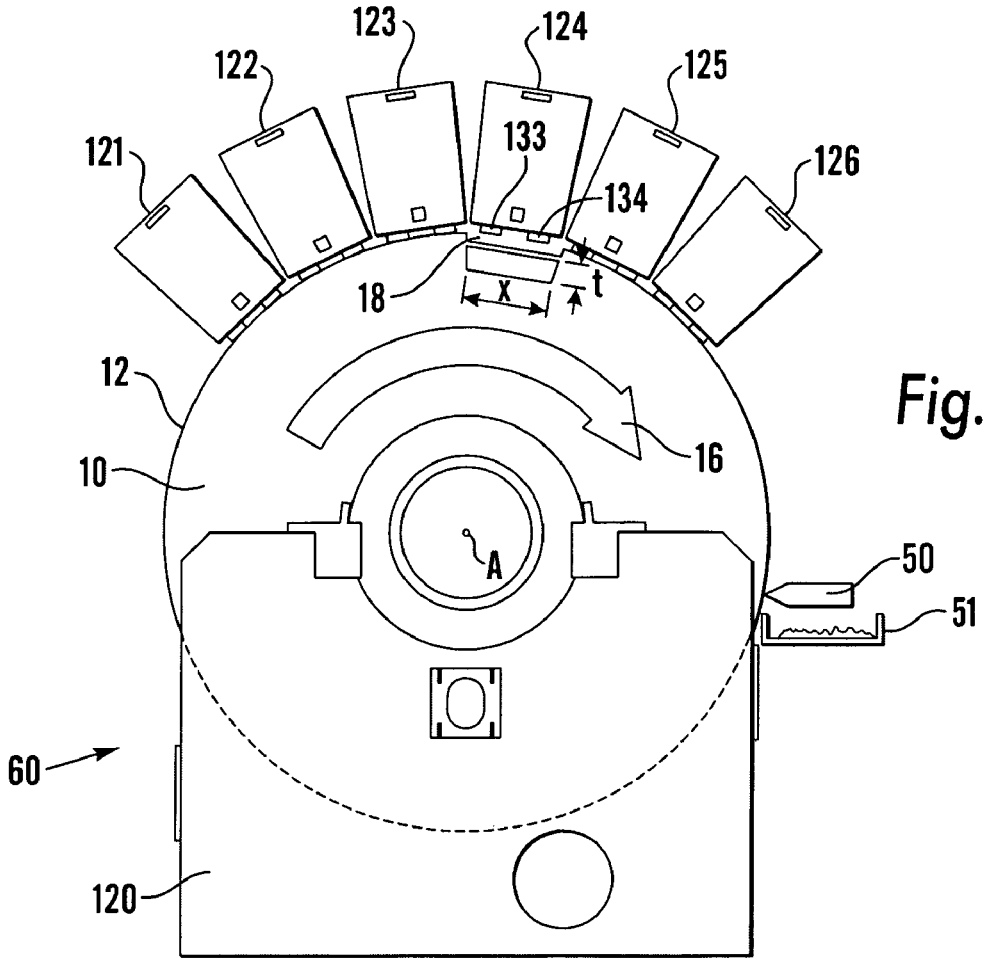
FIG. 1 is a front view of a printer in accordance with a first embodiment of the present invention including a rotating drum.

Referring to the drawings, FIG. 1 shows a front view of the printing components of an ink-jet printer 60 comprising a rotatably-driven drum platen 10 mounted to rotate as indicated by arrow 16 about an axis A on a fixed chassis 120.

Figure 2A:
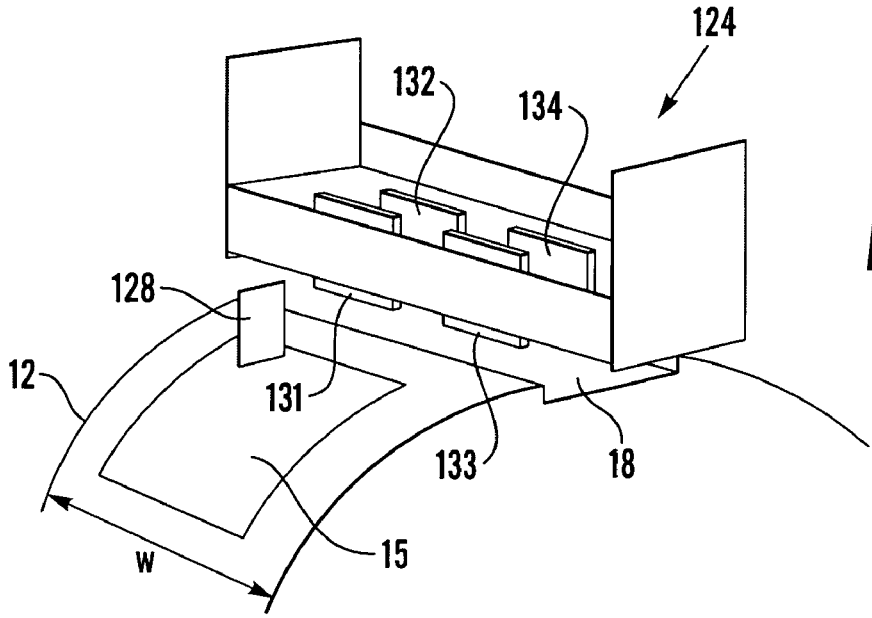
FIG. 2*a* is a perspective view of a print bar of the printer of FIG. 1.

The drum is arranged to carry print media sheets 15 on its circumferential surface 12, and sheet-handling means (not shown) are provided for feeding sheets to, and removing sheets from, the drum. The axial dimension or length "w" of the drum, shown in the perspective view of FIG. 2*a* is slightly larger than the width of the widest print media to be carried by the drum.

Figure 2B:
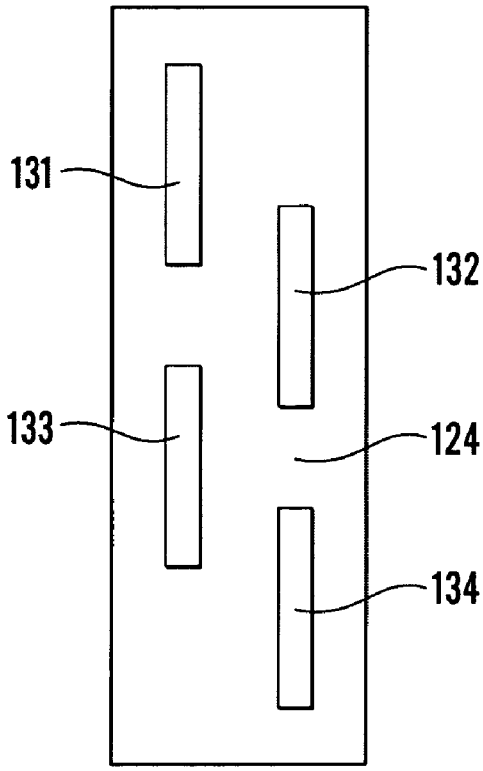
FIG. 2*b* is an enlarged top plan view of the print dies of the print bar of FIG. 2*a;*

The printer 60 is of the page-wide array type. Adjacently-spaced around the circumference of the drum 10 and fixed relative to chassis 120 are six printheads in the form of print bars 121 to 126. Each print bar is arranged to apply drops of a respectively-coloured ink onto print media sheets 15 as they pass underneath the print bar. A typical print bar 124 is shown in FIG. 2*a*, the other bars being omitted for the purposes of clarity. Print bar 124 comprises four rectangular print dies 131 to 134 arranged with their longitudinal axes parallel to the drum axis A. The dies 131 to 134 extend over substantially the entire length "w" of the drum and are arranged in staggered formation in two rows of two as shown in FIG. 2*b*.

Adjacent dies in the different rows, e.g. 131 and 132 are arranged to overlap slightly to ensure that ink can be applied evenly over the entire width of each print media sheet 15. Each die typically contains two rows of ink-jet nozzles.

Figure 3:
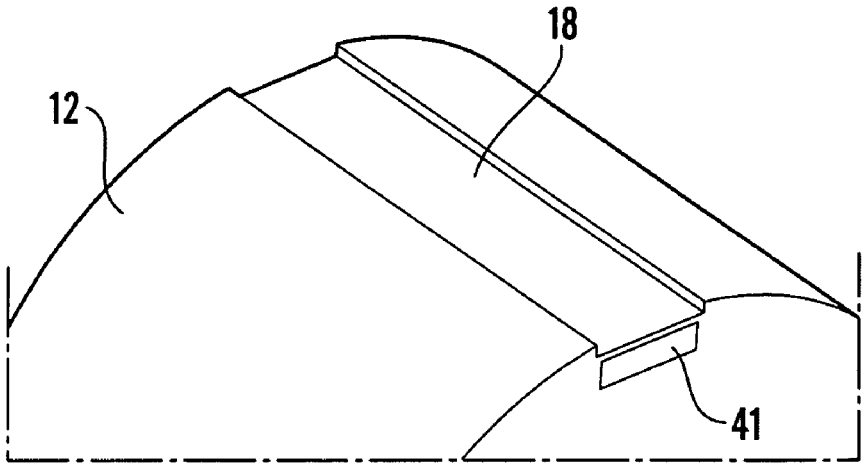
FIG. 3 is a perspective view of part of the drum of FIG. 1.

At one circumferential location, the surface 12 of the drum is provided with an axially-extending recessed area 18 in the form of a slot with a length "w" and a width "x" corresponding approximately to the same dimensions of a print bar 124. The recessed area has a depth "t". The recessed area 18 is arranged to serve as a spittoon to receive ink discharged from the printheads 121 to 126 outside normal printing operations. Beneath the area 18 there is provided an electrical heater 41, FIG. 3, which serves to dry ink collected by the spittoon. As more ink is spit and dried, a solid residue accumulates in area 18.

Figure 4:
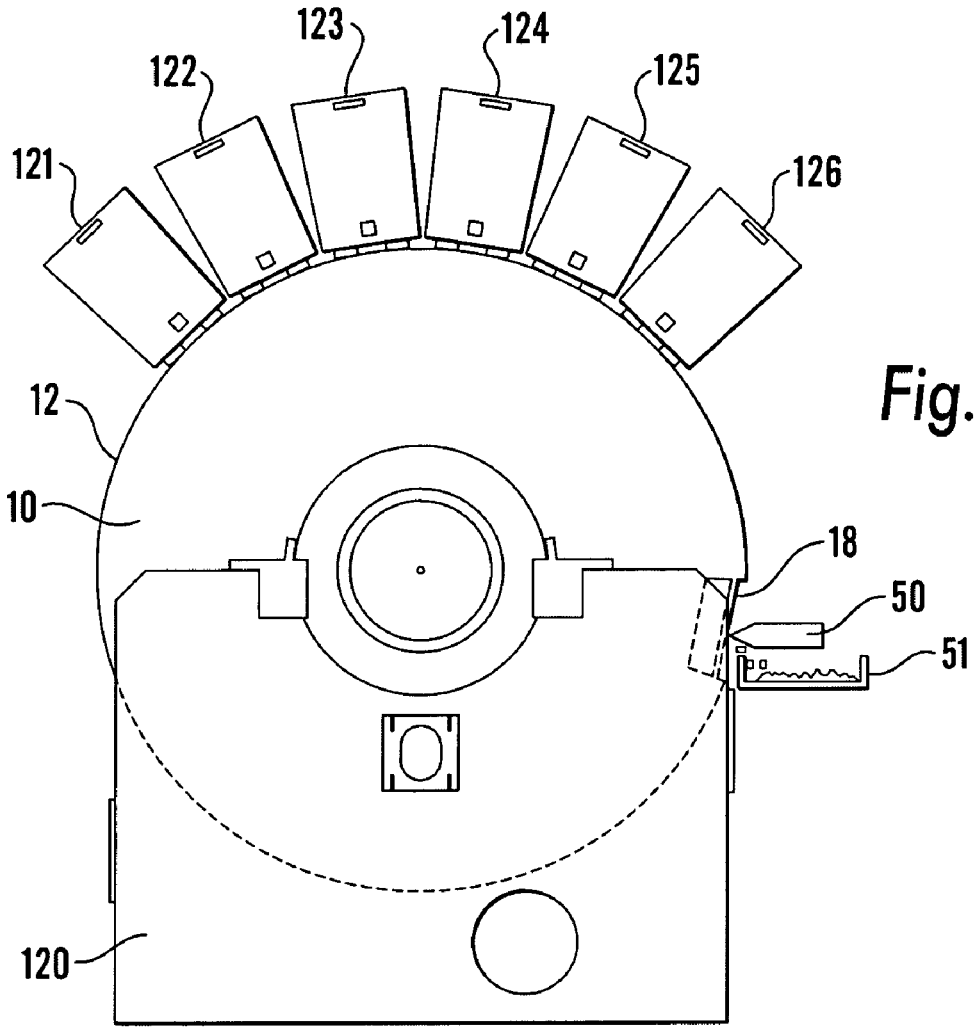
FIG. 4 is a front view similar to FIG. 1 but with the drum in a different position.

Attached to the chassis 120 at a location spaced from the printheads 121 to 126 is a scraper blade 50, which can be actuated to move from the position shown in FIG. 1, in which it is located radially outwardly of the drum surface 12, to the position shown in FIG. 4, in which it has been moved a distance "t" radially inwardly of surface 12, so that it can scrape the bottom of the spittoon area 18. A receptacle or container 51 fixed to the chassis 120 is provided below the scraper blade 50.

Figure 5:
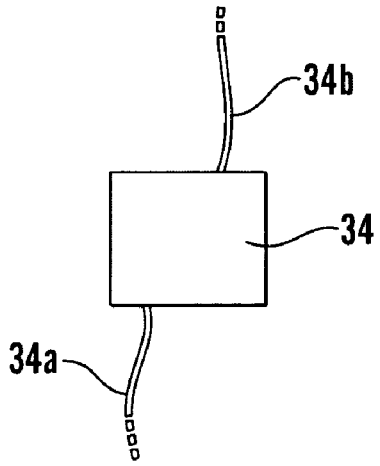
FIG. 5 is a schematic view of a print controller for use with the printer.

Referring to FIG. 5, the printer according to the present embodiment also has a print controller 34. This may be a conventional general purpose microprocessor or an ASIC, as is schematically illustrated in the Figure. As is conventional in many printing systems, the controller 34 may receive instructions via a conventional communication link 34*a* from a host device (not shown), which is typically a computer, such as a personal computer or a computer aided drafting (CAD) computer system. The printer controller 34 may also operate in response to user inputs provided through a user input device, such as a keypad or status display portion (not shown). Such user input devices are generally located on the exterior of the casing (not shown) of the printer. The printer controller 34 has associated memory (not shown), which may include ROM, RAM and a non-volatile data storage module, such as a high capacity hard disk drive.

Image data, downloaded from a host device, may be stored in the RAM prior to being printed. The printer operating instructions, may be stored in ROM which the controller 34 may access in order to carry out the functions of the printer.

In operation, the controller 34 outputs control instructions to control the operation of the printer via a communications link 34*b*. In this manner, the controller causes the drum 10 to rotate and sheets 15 of print media to be loaded onto the drum in a conventional manner by controlling the necessary actuators. The controller also causes the ink ejection nozzles to eject ink drops onto the print media to print a print job in a normal manner as the media passes beneath the print bar. The controller also instructs the ejection of ink drops into the spittoon area 18 and the switching on of the electrical heater 41 at appropriate times. At appropriate intervals the controller causes the spittoon are 18 to be moved to the scraping position and actuates the scraper blade 50.

Figure 6:
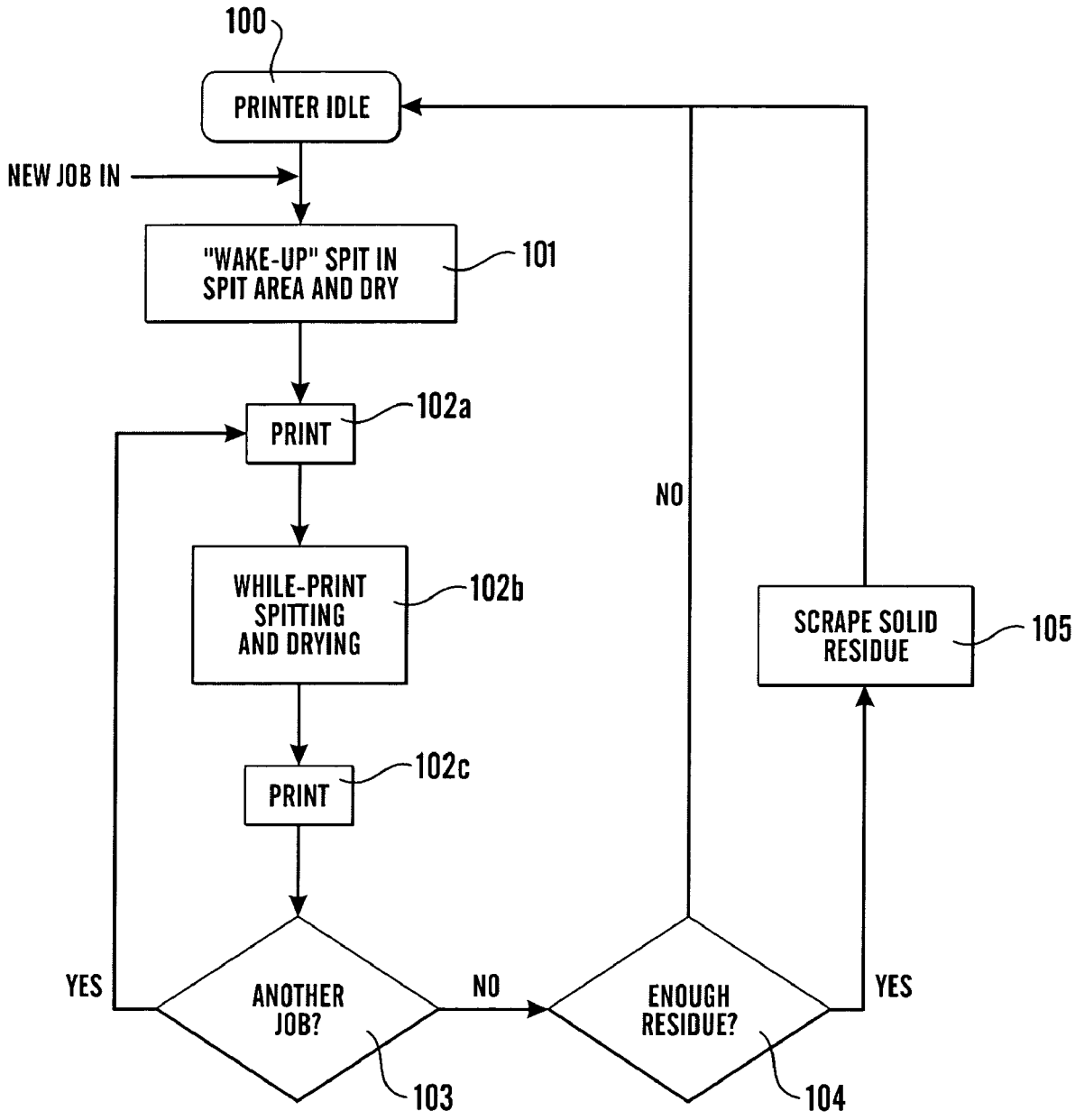
FIG. 6 is a flowchart representing the steps in a method in accordance with the present invention.

In normal use of the printer, a succession of printing jobs are carried out as illustrated in the flowchart of FIG. 6. After a state 100 in which the printer is idle a new job comes in. To prime the printer so that it can print correctly formulated inks to produce light print quality, at step 101 a so-called "Wake Up" spit of ink is spit from each print bar into the spittoon area 18, where it is dried by heater 41. A print operation 102*a* is then undertaken. At certain times during the print operation, it may be required to undertake a servicing operation including further spitting and ink-drying step 102*b*. By causing the print bars to spit as area 18 passes beneath them, it is not necessary to slow down the drum for this operation and so printing does not need to be interrupted. The print operation then continues at step 102*c* until it is finished.

If at step 103, it is determined that another job is waiting, this is immediately undertaken. If no job is waiting, then a decision is taken as to whether to remove the accumulated solid ink residue from spittoon area 18.

The solid ink residue removal process will now be described. Printing operations having been suspended; drum 10 is rotated to its position shown in FIG. 4 and then stopped with spittoon area 18 facing the scraper blade 50. Blade 50 is then actuated to move radially inwards to engage the bottom of the recessed area and then to move along the bottom of the recessed area in a reciprocating manner so that solid ink residue is scraped out of the spittoon and into the container 51.

Returning to FIG. 6, the decision in step 104, whether there is enough residue in spittoon area 18 to require a scraping operation, is based on the current content of an ink drop counter 128. If it is decided that there is not yet enough residue, the printer returns to its idle state 100. If there is sufficient residue in spittoon area 18 to justify a scraping operation 105, this is then undertaken or described above.

The above-described arrangement has several advantages. In particular the employment of the heater 41 causes the ink to quickly adhere to the surface of the spittoon area 18, thus preventing the ink drum being expelled from the spittoon by centrifugal force. The heater quickly reduces the ink waste product to residues having a minimal volume. These residues, which result from solids originally dissolved or suspended in the ink, can be collected in container 51 at times which do not interfere with normal printing operations and which do not require movement of the print bars out of their printing position. In addition, the arrangement is compact.

The arrangement avoids the need to dispose of any liquid or moist product. Moreover, provided that the rate of accumulation of dried ink waste product is sufficiently low relative to the size of container 51, it may not be necessary to replace the container during the lifetime of the printer.

A further advantage is that all the printheads can share the same spittoon even if they contain mutually-incompatible inks. Such inks can cause precipitates to form in liquid-containing spittoons, which can develop into so-called "stalagmites" which can grow out of the spittoon and eventually the nozzle plates.

An advantage of the scraper blade 50 is that it extends along the entire length "w" of the drum, thus allowing dried ink residue to be removed from the spittoon area 18 relatively quickly. The spittoon scraping operation described in co-pending U.S. application Ser. No. 10/426,574 is relatively time-consuming, since the scraper blade has to be moved along the entire length "w" of the drum.

The heater 41 preferably comprises one or more electrical resistive heating elements. This provides a compact arrangement and the control of the heating function is easily effected. Alternatively heat may be conducted to the heater from elsewhere in the drum 10. In a further alternative hot air may be conveyed to the heater by convection or by force flow.

The heater 41 may be arranged to be switched on whenever controller 34 instructs ink drops to be ejected into spittoon area 18. The actual moment of switching on may be determined by the controller to be in advance of the spitting operation, simultaneously with initiation of the spitting operation, a predetermined time after invitation of the spitting operation, or as soon as A predetermined amount of ink has been ejected during a spitting operation.

In a modification, blade 50 only moves radially in and out, the scraping action being achieved by causing the drum 10 to undergo small reciprocating rotary movements.

In a further modification, the radial movements of the scraper blade 50 are undertaken while the drum is still rotating at its normal speed. This requires a relatively-quickly movable scraper blade 50 but enables scraping to be undertaken during a printing operation without interrupting it. Blade 50 may have a rotary mounting coaxial with the drum, so that blade 50 can execute an arcuate path to scrape the spittoon area 18. Instead of being fixed to the printer chassis 120, the receptacle 51 may also have a rotary mounting, so that it can move with scraper 50 in an arcuate path.

During a scraping operation, the drum may rotate at a speed slower than its normal speed.

Other movements of the scraper blade 50 relative to spittoon area 18 may be employed.

Means (not shown) may be provided for intermittently removing the contents of container 51 to another container.

Instead of scraper blade 50, other devices may be employed for removing the ink residue.

The width "x" of the slot 18 may be larger than the width of print bar 124. This reduces the risk of ink encroaching on the adjacent surface 12 of the drum and enables a faster speed of drum rotation to be maintained during spitting. Alternatively, the width "x" of the slot may be narrower than the width of print bar 124. For example it may have a width corresponding to that of a print die such as 131. The slot width may be even smaller provided that it remains sufficiently large to catch individual ink drops.

The length "w" of the slot 18 may be larger than the length of print bar 124. This prevents ink reaching undesired regions of the drum surface 12. Alternatively, the length "w" of the slot may be smaller than the length of the print bar 124, provided that it is long enough to catch ink from all the nozzles.

A print bar 124 may have a single long print die extending across the entire length "w" of the drum instead of a plurality of dies such as 131 to 134.

Any number of print bars 124 etc. may be used depending upon the number of different inks required. The term "ink" incorporates "fixer" or other type of deposit.

The drum 10 may incorporate other service station modules for undertaking servicing operations on the or each print bar. These other modules may incorporate one or more of a wiping assembly, a capping assembly, an assembly for applying a cleaning and lubricating fluid, a nozzle scraping assembly, a snout wiping assembly, an assembly for priming the nozzles and a drop detection assembly.

In a modification of the arrangement of FIG. 1, the print media carrying surface portion and the spittoon forming portion, instead of being located on a drum platen, are located on the surface of a platen formed by a continuous belt travelling over rollers. The belt is of relatively thick material so that the recessed spittoon area 18 and its associated heater 41 can be incorporated therein.

Figure 7:
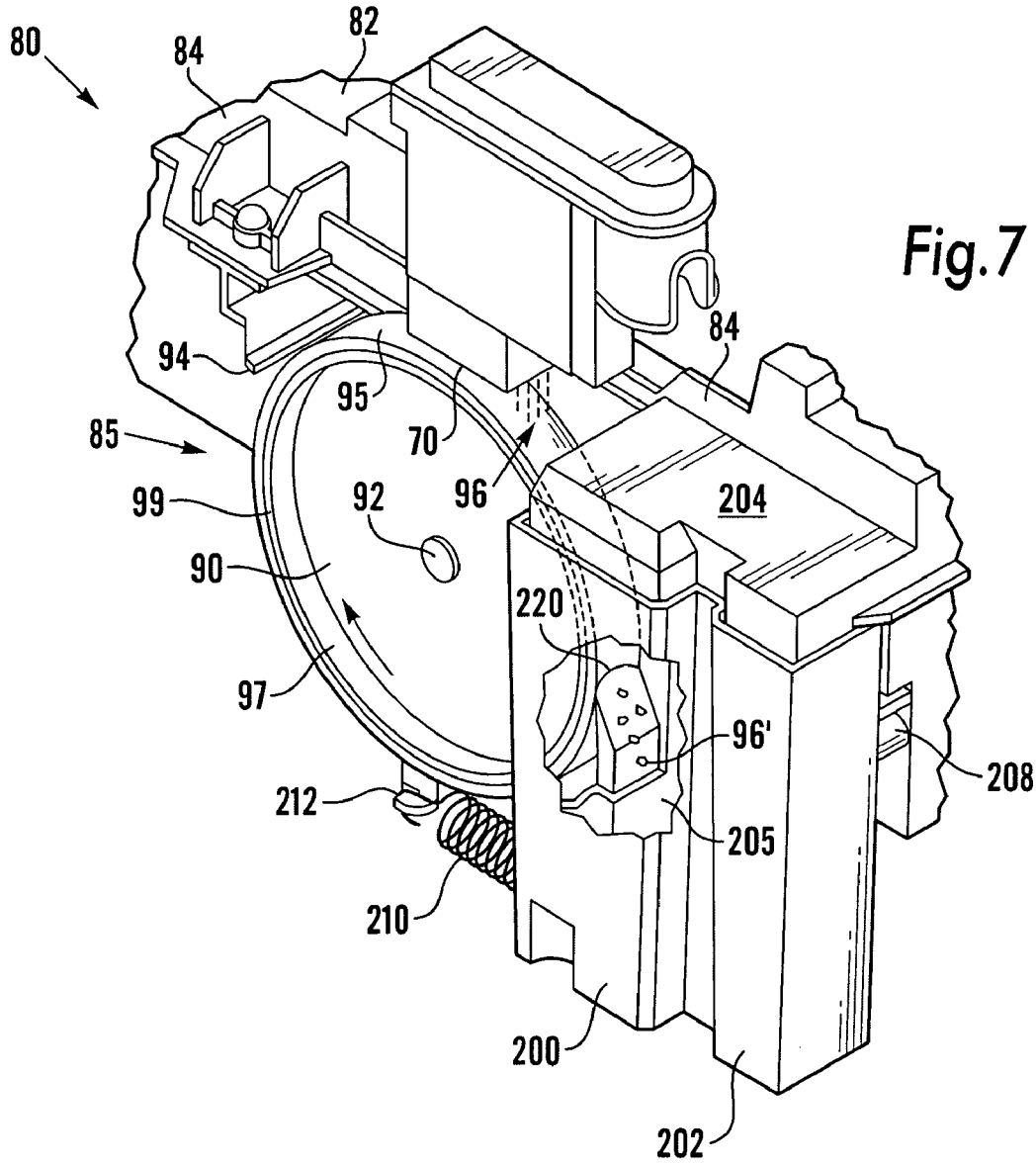
FIG. 7 is a perspective view of a service station of a printer in accordance with a second embodiment of the present invention.

Referring now to FIG. 7, an ink-jet printer in accordance with a second embodiment of the present invention is of the scanning type. Such a printer is disclosed in U.S. Pat. No. 6,340,320. A service station 80 of the printer has a main frame 82 that is supported by a printer chassis in a servicing region within a printer casing. The service station frame 82 has a sidewall 84 which supports a portion of a transferring spittoon system 85 as a portion of the service station 80 for handling waste inkjet ink deposited in particular by a printhead 70. Printhead 70 is mounted on a carriage (not shown) which in use undertakes scanning type movements over a print media.

A motor and gear assembly (not shown) drives a spittoon wheel portion 90 of the transferring spittoon system 85. The transferring spittoon system 85 includes a spindle or sidewall 84 to rotationally support the spit wheel 90. A back-up wheel scraper 94 extends from the sidewall 84 to stop any accumulation of ink residue, which may have inadvertently adhered to the spit wheel, from passing under and possibly damaging the printhead 70. The spit wheel 90 has an outer rim 95, which preferably has a concave shaped cross section, to serve as a spit platform for receiving waste ink spit 96 from the printhead 70. Preferably, the spit wheel 90 is mounted to receive the ink spit 96 along a descending portion thereof, as the wheel 90 is rotated in the direction of arrow 97. Preferably, the spit wheel 90 is constructed of an ink-resistant, non-wetting material with dimensional stability, such as a glass fiber filled blend of polyphenylene oxide and polyethylene. As part of the rim 95 there is provided a circumferentially-extending electrical heater 99 corresponding to the heater 41 of the first embodiment.

Another component of the spittoon system 85 is an ink residue storage container or bucket 200, which has a hollow body 202 that is preferably covered by a cover position 204 extending outwardly from the service station frame sidewall 84. As spit wheel 90 rotates the ink 96 deposited thereon is dried by heater 99 and then fed as dried ink residues $\mathbf{96}^1$ where it is temporarily stored.

A printer controller (not shown), corresponding to controller 34 of the first embodiment, provides control signals to operate the motor and gear assembly to rotate wheel 90 and to switch on and off the heater 99.

Together, the container body 202 and cover portion 204 define a storage cavity or chamber 205 therein for receiving and holding the dried ink spit residue $\mathbf{96}^1$ prior to transfer to a permanent storage location. The container body 202 is preferably pivotally mounted to the frame sidewall 84 at a pivot post 208 which projects outwardly from wall 84. The container 200 pivots around post 208 and is resiliently pulled toward the spit wheel 90 by a biasing member, such as a tension spring 210 which joins a mounting tab portion 212 that extends outwardly from the sidewall 84. The service station frame 82, the spit wheel 90, and the storage bucket 200 may have other mating features to align the wheel and bucket to guide the solid residue $\mathbf{96}^1$ from the wheel rim 95 into the bucket.

Another component of the transferring spittoon system 85 is a spit wheel scraper 220, which may be moulded integrally with the bucket 200 beneath a chamber entrance portal that is defined by the container body 202 and/or the cover portion 204. It is apparent that the wheel scraper 220 may also be constructed as a separate member attached to the bucket.

In the illustrated embodiment, the scraper 220 is constructed of the same hard plastic material as the bucket body 202. Alternatively the scraper may be constructed of an ink-resistant, non-wetting, low density polyethylene that is soft enough to have a compliant nature to allows the scraper to conform to the concave contour of the wheel rim.

As disclosed in U.S. Pat. No. 6,340,220, the dried ink residue 96' may be removed from storage bucket 200 to a permanent storage location by a screw member.

An advantage of the above-described arrangement is that the ink residue $\mathbf{96}^1$ is substantially dry relatively soon after the ink 96 has been deposited on the wheel 90. Accordingly, the possibility of incompletely dried ink components running off the wheel 90 in an undesired manner into other parts of the printer is substantially reduced. The dried ink residue $\mathbf{96}^1$ is also easier to scrape off the wheel.

In a modification, the dried ink residue $\mathbf{96}^1$ is permanently stored in bucket 200.

Heated spittoons according to the present invention may be employed in a wide range of printers and other hardcopy devices. For example a heater may be incorporated in a wheel spittoon of the type shown at 80 in FIG. 2 of U.S. Pat. No. 5,617,124, or in a spittoon roller of the type shown at 102 in FIG. 5 of the same U.S. patent. The contents of U.S. Pat. No. 5,617,124 are hereby incorporated by reference.

Figure 8:
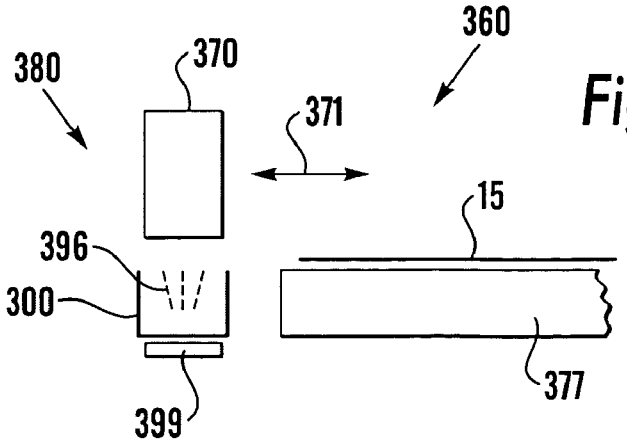
FIG. 8 is a schematic view of a printer in accordance with a third embodiment of the present invention.

Referring now to FIG. 8, a printer 360 in accordance with a third embodiment of the present invention comprises a printhead 370 mounted on carriage (not shown) which undertakes scanning movements in the direction indicated by arrow 371 over a print media 15 on a stationary printer platen 377. Print media is moved in a direction perpendicular to the plane of the drawing.

The printer 360 has a service station section 380 which incorporates a spittoon container 300 mounted to be fixedly attached to the printer chassis. Container 300 has a heater 399. To undertake a spitting operation, printhead 370 is moved beyond the edge of the print media 15 to the position shown in FIG. 8. A spitting operation is undertaken, and ink 396 is ejected into the container 300, where it is then dried by the heater 399. The dried ink residue may be permanently stored in the spittoon container. Alternatively, the spittoon may be provided with a removal member, such as the screw member disclosed in U.S. Pat. No. 6,340,220, for removing the dried ink residue from the container to a permanent storage location. In a further alternative, the spittoon container may be arranged to be removable, in which case it can be either cleaned for re-use or discarded and replaced by a fresh container.

The features and modifications of the spittoon arrangements described above, and the arrangements disclosed in co-pending U.S. application Ser. No. 10/426,574 may be combined or interchanged as desired.

What has been described and illustrated herein is a preferred embodiment of the invention along with some of its variations. The terms, descriptions and figures used herein are set forth by way of illustration only and are not meant as limitations. Those skilled in the art will recognise that many variations are possible within the spirit and scope of the invention, which is intended to be defined by the following claims—and their equivalents—in which all terms are meant in their broadest reasonable sense unless otherwise indicated.

What is claimed is:

1. A hardcopy device comprising:

a printhead fixedly mounted on a hardcopy device adjacent to a rotatable drum;

a spittoon arranged to receive ink from said printhead;

a print media carrier provided on said rotatable drum;

a heater arranged to heat ink received in said spittoon; and a scraper adjacent to said drum, said scraper being spaced from said printhead circumferentially around said drum, said scraper configured to scrape out heated ink residue out of said spittoon and put the heated ink residue into a container, and wherein said spittoon is movably mounted on said hardcopy device, such that the spittoon is mounted on said rotatable drum.

2. A hardcopy device according to claim 1, wherein said heater comprises an electrical resistance element.

3. A hardcopy device according to claim 1, and further comprising a controller, said controller controlling said printhead to eject ink into said spittoon and controlling the switching on of said heater.

4. A hardcopy device according to claim 1, wherein the heater is positioned below the spittoon.

5. A hardcopy device according to 1, wherein the heater is positioned on the drum.

6. A hardcopy device according to claim 1, wherein said scraper is arranged to be moved radially relative to a circumferential surface of said drum.

7. A hardcopy device according to claim 6, wherein said drum has a width and said scraper extends along substantially the entirety of said width of said drum and is arranged to be moved in a reciprocating manner in a circumferential direction and parallel relative to the circumferential surface of said drum.

8. A hardcopy device comprising a rotatable drum having a circumferential surface, a print media carrier region being provided on said circumferential surface, and said circumferential surface having a width, an elongated spittoon region extending across substantially the entirety of said width of the circumferential surface of said drum, and a removal device for removing any contents of said spittoon region, said removal device being movable radially relative to said drum, and wherein said removal device is movable in a circumferential direction and parallel relative to the circumferential surface of said drum, such that the removal device is configured to move around and over a circumferential surface of said drum.

9. A hardcopy device according to claim 8, wherein said removal device is movable in a reciprocating manner parallel to the circumferential surface of said drum.

10. A hardcopy device according to claim 8, wherein said removal device extends substantially across the entirety of said width of the circumferential surface of said drum.

11. A hardcopy device according to claim 8, wherein said removal device includes a scraper blade.

12. A hardcopy device according to claim 8, further comprising a heater arranged to heat ink received in said spittoon region, the heater positioned below the spittoon region.

* * * * *

UNITED STATES PATENT AND TRADEMARK OFFICE

CERTIFICATE OF CORRECTION

PATENT NO. : 7,175,251 B2
APPLICATION NO. : 10/762303
DATED : February 13, 2007
INVENTOR(S) : Gonzalo Gaston et al.

It is certified that error appears in the above-identified patent and that said Letters Patent is hereby corrected as shown below:

In column 8, line 24, delete "96'" and insert -- $96^1$ --, therefor.

In column 9, line 36, in Claim 5, after "according to" insert -- claim --.

Signed and Sealed this

Eleventh Day of November, 2008

JON W. DUDAS
*Director of the United States Patent and Trademark Office*